United States Patent [19]

Waniisi et al.

[11] Patent Number: 4,566,803

[45] Date of Patent: Jan. 28, 1986

[54] POWER SOURCE OFF DELAY TIMER WITH LIQUID CRYSTAL DISPLAY

[75] Inventors: Tetuya Waniisi; Hiroshi Sato, both of Okayama; Isao Nanba, Kurashiki, all of Japan

[73] Assignee: Omron Tateisi Electronics Co., Kyoto, Japan

[21] Appl. No.: 654,490

[22] Filed: Sep. 26, 1984

[30] Foreign Application Priority Data

Sep. 27, 1983 [JP] Japan ..... 58-149161[U]

[51] Int. Cl.[4] ..... G04B 9/00; G04F 8/00

[52] U.S. Cl. ..... 368/66; 368/109; 320/1; 307/64

[58] Field of Search ..... 368/66, 107–113, 368/243, 250; 320/1; 323/323, 326; 340/654, 660, 663, 333, 366 R, 377; 307/43, 46, 48, 64, 66

[56] References Cited

U.S. PATENT DOCUMENTS

| | | | |
|---|---|---|---|
| 3,641,545 | 2/1972 | Okada | 368/66 |
| 3,678,499 | 7/1972 | McCarty | 368/66 |
| 3,750,123 | 7/1973 | Caillouet | 307/64 |
| 3,753,001 | 8/1973 | Hiroshima et al. | 307/64 |
| 3,968,417 | 7/1976 | Dials | 368/204 |
| 4,189,649 | 2/1980 | Przywozny et al. | 307/64 |
| 4,404,624 | 9/1983 | Tamazaki | 368/204 |

*Primary Examiner*—Vit W. Miska

*Attorney, Agent, or Firm*—Wegner & Bretschneider

[57] ABSTRACT

A power source off delay timer generates an off delay output after passage of a determinate time delay period from when an input power source is switched off. This timer includes a main body, a liquid crystal display mounted to the main body so as to display the operational condition of the timer, and a liquid crystal display drive unit for driving the liquid crystal display during the time that the power source is on and also during the determinate time delay period between the time instant at which the power source is switched off and the subsequent time instant at which the timer generates the off delay output. Thereby, the position of the liquid crystal display may be substantially arbitrarily selected, and also the position of the keep relay may be arbitrarily chosen. And because the liquid crystal display and also the drive unit therefore have typically very low power consumptions, it is possible to keep them in operation without exhausting the power source such as a capacitor for operating the timer after the power source has been switched off, even if the delay time period is very long. A variable resistor may be used for adjusting the time delay period; and the system may include a flasher circuit for flashing the liquid crystal display, to make its indication even more visible.

5 Claims, 4 Drawing Figures

POWER SOURCE OFF DELAY TIMER WITH LIQUID CRYSTAL DISPLAY

BACKGROUND OF THE INVENTION

The present invention relates to a power source off delay timer for use in an electric control device, and more particularly relates to such a power source off delay timer which times a certain time period after a power source has become shut off and then outputs a signal or the like.

A certain type of power source off delay timer is per se known which controls a keep relay. Such a power source off delay timer, when a power source is shut off, starts timing a certain time period of for example 0.5 seconds to 10 minutes, and at the end of this time period resets the keep relay. Now, it is convenient for a user of the power source off delay timer to be able ocularly to determine what is the current state of the device, i.e. to monitor it, and accordingly some visual indication of operation state is desirable. It might be conceived of to use a monitor lamp for displaying the operation state, and in such a case the lamp should be illuminated during the time that the power source is on and also during the time interval that the power source off delay timer is operating, between the time point at which the power source has turned off and the later time point that the power source off delay timer resets the keep relay. However, after the power source has turned off, the system must operate by using power stored in a capacitor or the like until the resetting of the keep relay, and the electrical power consumption of such a monitor lamp is too great for it to be operated by power stored in a capacitor for any reasonable time. This means that with the use of such a monitor lamp the time period which the power source off delay timer can time after the power source turns off is very limited, and for this reason the use of a monitor lamp in this type of power source off delay timer construction is virtually impracticable.

Accordingly, in a conventional power source off delay timer, for monitoring purposes it has been practiced to use a physical indicator such as a colored plate, which is moved in synchronization with the operation of the keep relay. In such a power source off delay timer, as one possible construction, the movement of a red indicator plate is coupled to the operation of the keep relay, and when the keep relay is in the set condition then the red indicator plate is in a position to be visible through a display window, whereas on the other hand when the keep relay is moved to the reset condition then the red indicator plate is moved and is hidden and thus is not in a position to be visible through said display window. Thus, the operational state of the device can be monitored by the operator by watching the display window.

However, in this type of construction, it is necessary to incorporate a linkage motion mechanism in the power source off delay timer for moving the colored plate in synchronization with the setting and the resetting of the keep relay. This causes the inconvenience that the mounting position of the keep relay becomes restricted, and also the mounting position of the display window becomes restricted. Thus, often, the keep relay cannot be mounted in a convenient position from the viewpoint of its operation, and also the display window cannot be placed in a position in which it is easily visible. Further, in this type of mechanical display device construction, a display which attracts the attention of the operator in a dynamic fashion, such as by periodic flashing or the like, cannot be provided.

SUMMARY OF THE INVENTION

Accordingly, it is the primary object of the present invention to provide a power source off delay timer which avoids the above mentioned problems.

It is a further object of the present invention to provide such a power source off delay timer which can provide an ocular indication to the operator of its operation state.

It is a further object of the present invention to provide such a power source off delay timer which can provide such an ocular indication even for quite a long timed period after stopping of power supply.

It is a further object of the present invention to provide such a power source off delay timer which does not risk that such an ocular indication of operation should unduly deplete its own power supply reserves.

It is a further object of the present invention to provide such a power source off delay timer which does not involve any physical linkage mechanism between its keep relay and a means for providing said ocular indication.

It is a yet further object of the present invention to provide such a power source off delay timer which allows the mounting position of its said means for providing said ocular indication to be substantially arbitrarily chosen.

It is a yet further object of the present invention to provide such a power source off delay timer which allows its means for providing said ocular indication to be very conveniently viewable by its operator.

It is a yet further object of the present invention to provide such a power source off delay timer which allows the mounting position of its keep relay to be substantially arbitrarily chosen.

It is a yet further object of the present invention to provide such a power source off delay timer which can provide such an ocular indication which is very noticeable.

It is a yet further object of the present invention to provide such a power source off delay timer which can provide such an ocular indication which flashes periodically.

It is a yet further object of the present invention to provide such a power source off delay timer which can provide such an ocular indication which is reliable.

It is a yet further object of the present invention to provide such a power source off delay timer which in itself is compact.

According to the most general aspect of the present invention, these and other objects are accomplished by a power source off delay timer, for generating an off delay output after passage of a determinate time delay period from when an input power source is switched off, comprising: (a) a main body; (b) a liquid crystal display mounted to said main body so as to display the operational condition of said timer; and (c) a liquid crystal display drive unit for driving said liquid crystal display during the time that said power source is on and also during said determinate time delay period between the time instant at which said power source is switched off and the time instant at which said timer generates said off delay output.

According to such a structure, the liquid crystal display is driven by the drive unit therefor while the power source is on, so as to generate an "ON" signal or the like, and then, when said power source is switched off, during said determinate time delay period before said timer generates said off delay output, said liquid crystal display continues to be driven by the drive unit, so that the "ON" indication continues to be displayed during this time delay period. Then, when said timer generates said off delay output, said liquid crystal display ceases to be driven by the drive unit, so that the "ON" indication ceases to be displayed. Accordingly, this power source off delay timer can provide an ocular indication to the operator of its operation state, i.e. as to whether the off delay output has been produced yet or not. And, because the electric power consumption of an LCD is extremely small, and also the typical power consumption of such a drive unit for such an LCD is also extremely small, this power source off delay timer can provide such an ocular indication even for quite a long timed period after stopping of power supply, without putting too much of a strain on the power source such as a capacitor for example which may be used for powering such a power source off delay timer, and which may be extremely limited in terms of available power. Accordingly, this power source off delay timer does not risk that its ocular indication of operation should unduly deplete its own power supply reserves. Further, because this power source off delay timer does not involve any mechanical moving linkage mechanism between its keep relay and a means for providing said ocular indication, accordingly it allows the mounting position of its said means for providing said ocular indication, i.e. the LCD, to be substantially arbitrarily chosen, which makes it very convenient for being viewed by the operator, and also it allows the mounting position of its keep relay to be substantially arbitrarily chosen. Further, this type of power source off delay timer can provide such an ocular indication which is very noticeable, because it can have included in it an LCD flasher circuit which flashes periodically. And, because the operation of the display means of this power source off delay timer is not mechanical as in the case of the prior arts mentioned above, but electronic, and does not involve any moving parts, it provides an ocular indication which is reliable. And, because of the inherent compactness of an LCD, this power source off delay timer in itself is compact.

Further, according to a more particular aspect of the present invention, these and other objects are more particularly and concretely accomplished by a power source off delay timer as described above, further comprising a variable resistance whose set value determines said determinate time delay period.

According to such a structure, the determinate time delay period may be controlled conveniently.

Further, according to a yet more particular aspect of the present invention, these and other objects are yet more particularly and concretely accomplished by a power source off delay timer as described above, further comprising a flasher circuit for flashing said liquid crystal display when it is being driven.

According to such a structure, the liquid crystal display can be all the more easily seen by the operator.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENT

Figure 1:
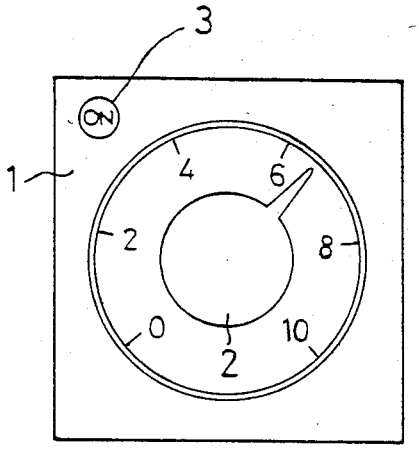
FIG. 1 is a front view of the preferred embodiment of the power source off delay timer of the present invention.
Figure 2:
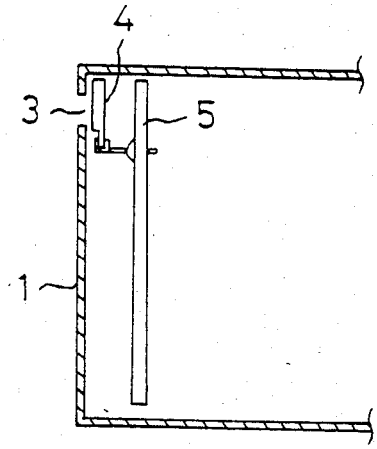
FIG. 2 is a schematic sectional view of said preferred embodiment as seen from the side.
Figure 3:
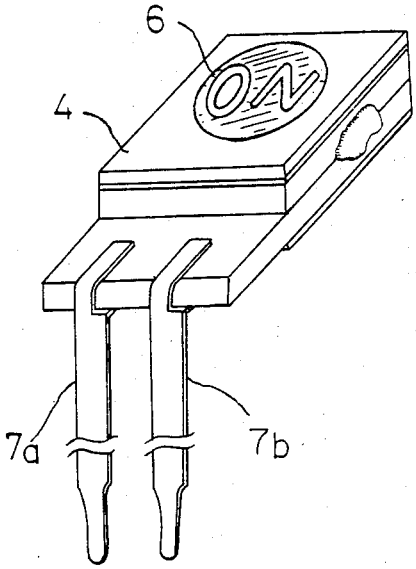
FIG. 3 is an external perspective view of an LCD display unit incorporated in said preferred embodiment of the present invention.
Figure 4:
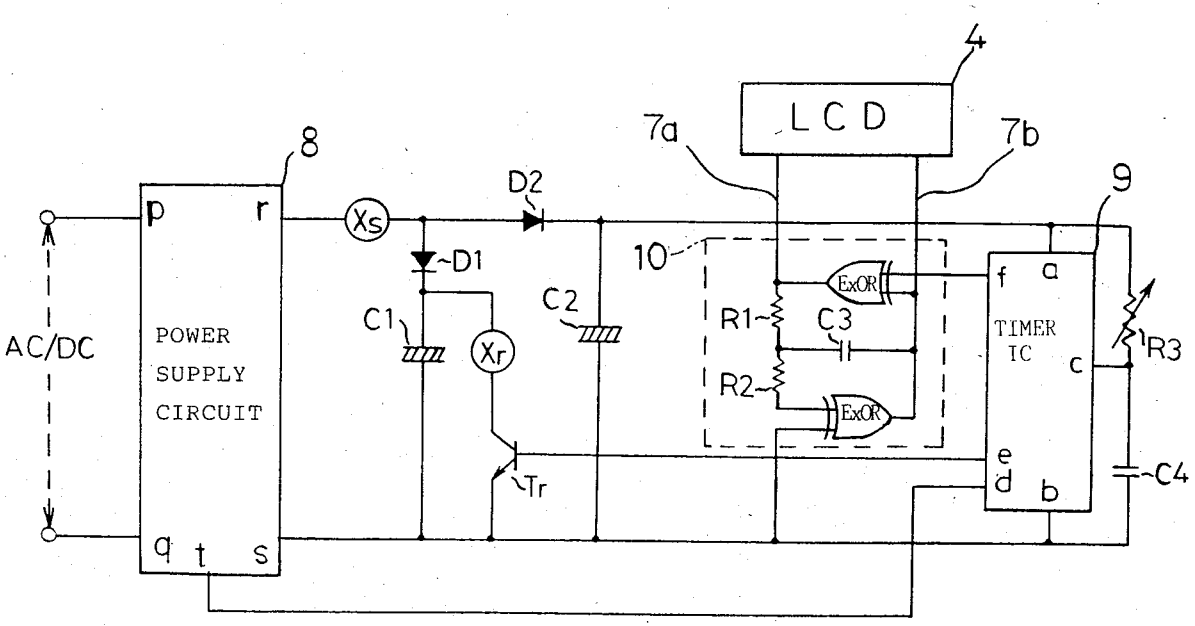
FIG. 4 is a circuit diagram of the electrical circuitry of said preferred embodiment of the present invention.

The present invention will now be described with reference to the preferred embodiment thereof, and with reference to the appended drawings. FIG. 1 is a front view of the preferred embodiment of the power source off delay timer of the present invention, and FIG. 2 is a sectional view thereof as seen from the side in FIG. 1. In these figures, the reference numeral 1 denotes the front panel of the timer, while 2 is a control knob for setting the time delay of said timer. A circular display window 3 is formed at the upper left corner of the front panel 1, and through this window 3, as best shown in FIG. 2, there can be seen an LCD 4, the terminals *7a* and *7b* of which are soldered to a printed circuit board 5, and which is supported thereby so as to be held behind the window 3. A perspective view of this LCD 4, and of its terminals *7a* and *7b*, is shown in FIG. 3, and here it is seen that said LCD 4 has a circular display surface 6, which is red in color when illuminated and bears a white indication of "ON", and which is supported as opposing the window 3; this display surface 6, when an electrical voltage is applied between its terminals *7a* and *7b*, is illuminated and thereby highlights the indication "ON". The printed circuit board 5 is supported within the body of the timer behind its front panel 1, and on it is formed the electrical circuitry of said preferred embodiment of the present invention, a diagram of which is shown in FIG. 4. This circuitry will now be explained.

This preferred embodiment of the power source off delay timer of the present invention comprises a keep relay, not shown in detail in the figures, which has a set coil Xs and a reset coil Xr. The keep relay is put into the set state by supply of current through the set coil Xs, and thereafter remains in the set state until a supply of current is put through the reset coil Xr when it transits to the reset state, in which it remains until the next time a supply of current is put through the set coil Xs again, when it transits back to the set state. Thus, the function is that after the lapse of a certain delay time from the cessation of power supply to the timer, a pulse of current is supplied through the reset coil Xr, so as to put the keep relay to the reset state. In FIG. 4, the reference numeral 8 denotes a power supply circuit, which is supplied with input power at its terminals p and q from a power source which may be AC or DC. This power supply circuit 8, when thus supplied with input power, produces a DC voltage between its terminals r and s; and, when the supply of input power stops, the power supply circuit 8 produces a power failure indication pulse at its terminal t. And the element 9 is a timer IC of a per se known type, and 10 is an LCD drive circuit.

A capacitor C1 is connected between the terminals r and s of the power supply circuit 8, in series with the set coil Xs of the keep relay and with a diode D1. One side of the reset coil Xr of the keep relay is connected to a point on this circuit between the capacitor C1 and the diode D1, and the other side of said reset coil Xr is connected to the collector of a switching transistor Tr, while the emitter of said switching transistor Tr is connected to the terminal s of the power supply circuit 8 and its base is connected to a terminal e of the timer IC 9. The capacitor C1 is for supplying a reset drive current to the reset coil Xr of the keep relay, after the power source is turned off, and after the lapse of the predetermined delay time. And the switching transistor Tr is a control switch for switching said reset drive current, and it turns on by receiving a reset coil drive signal from the terminal e of the timer IC 9. A point on the circuit between the set coil Xs of the keep relay and the diode D1 is connected via a diode D2 to a terminal a of the timer IC 9, which is also connected via a capacitor C2 to the terminal s of the power supply circuit 8, which is connected also to a terminal b of the timer IC 9. The capacitor C2 is for maintaining the action of the timer IC 9 by its electric discharge after the power supply is turned off, while the diodes D1 and D2 are for determining the flow of electric current.

A variable resistance R3 is connected between the terminal a of the timer IC 9 and another terminal c thereof, while a capacitor C4 is connected between said terminal c and the aforesaid terminal b of the timer IC 9. And the control spindle of the variable resistor R3, not shown, is connected to the control knob 2, previously discussed. The timer IC 9 oscillates at a frequency corresponding to the time constant **R3*C4 determined by the characteristics of this variable resistor R3 and this capacitor C4, and after the passage of a time period determined by the value of the variable resistor R3 outputs a pulse at its terminal e which is supplied to the base of the transistor Tr to turn it on. Specifically, the voltage across the capacitor C4 is supplied to the timer IC 9 across its terminals b and c, and when this voltage across the capacitor C4 has dropped below a certain specified threshold value the timer IC 9 outputs a pulse output from its output terminal e. Thus, when the power source is shut off, a power failure indication pulse is given from the terminal t of the power supply circuit 8 to the terminal d of the timer IC 9, which is a power failure detecting terminal. Between the time that the power source is turned on and the time that the final drive signal for the reset coil Xr of the keep relay is generated by the timer IC 9 outputting a pulse at its terminal e to the transistor Tr, an LCD drive signal is outputted from the terminal f of the timer IC 9 to the LCD drive circuit 10**.

The LCD drive circuit 10 is of a per se known type, and it produces an alternating square wave by the use of two connected exclusive OR gates (EXOR gates), in conjunction with a capacitor C3 and two resistors R1 and R2, and supplies this square wave signal to the terminals *7a* and *7b* of the LCD 4. Thus, when the LCD display signal is being outputted from the terminal f of the timer IC 9, which is during the time that the power source is on and also during the subsequent time period from when the power source has been turned off to when the time the reset coil Xr of the keep relay is energized, the LCD drive circuit 10 oscillates at a frequency corresponding to the time constant **R1*C3 determined by the characteristics of the resistor R1 and the capacitor C3, and produces an alternating square wave signal to drive the LCD 4 and to illuminate its display surface 6** so as to highlight the indication "ON" thereon.

Now, the off delay action of this shown preferred embodiment of the power source off delay timer of the present invention will be described. When the power source is turned on, the keep relay is put into the set state by the electric current which flows from the power supply circuit 8 through the set coil Xs and into the capacitor C1 to charge it, and both the capacitor C1 and also the capacitor C2 are charged up to their maximum extent. Since this drive voltage now is supplied to the timer IC 9, this timer IC 9 starts to oscillate at a frequency corresponding to the time constant **R3*C4 determined by the characteristics of the variable resistor R3 and the capacitor C4, i.e. corresponding to the time set by the operator on the knob 2 connected to the spindle of the variable resistor R3. However, at this time while the power source is still on, the timer IC 9 does not perform timer action, because no pulse has yet been supplied to its terminal d. Now, when the power source is turned off, then the power failure signal is outputted from the terminal t of the power supply circuit 8 to the power failure detecting terminal d of the timer IC 9, and further the timer IC 9 continues to be driven by the electricity stored up in the capacitor C2 (although not by that in the capacitor C1, due to the provision of the diode D1), and thus the timer 9 starts to time the time period determined by its current frequency of oscillation set by the variable resistor R3. After the passage of this determinate time period from the time of switching off of the power source, then the timer IC 9 outputs the reset coil drive signal from its terminal e, and this signal is supplied to the base of the transistor Tr so as to turn said transistor Tr on. As a result, the electrical energy in the capacitor C1** is all discharged through the transistor Tr and through the reset coil Xr of the keep relay, so as to put the keep relay into the reset state. Since this resetting of the keep relay has been performed after the expiration of the aforesaid determined time period delay after the time of switching off of the power source, the off delay action has been performed.

Meanwhile, during this action, the display action of the LCD 4 has been as follows. From the time that the power source was turned on and the timer IC 9 started to oscillate, the LCD drive signal was being outputted at the terminal f of said timer IC 9, and accordingly the LCD drive circuit 10 was being caused to oscillate, producing an alternating square wave which was driving the LCD 4 to illuminate its display surface 6 in red so as to highlight the indication "ON" thereon in white against said base red. After the power source is turned off, while as described above the timer IC 9 continues to be driven by the electricity stored up in the capacitor C2 and times the time period determined by its current frequency of oscillation set by the variable resistor R3, the LCD drive signal continues to be outputted at the terminal f of said timer IC 9, and accordingly the LCD drive circuit 10 continues to oscillate, and continues to produce the aforesaid alternating square wave to drive the LCD 4 to be illuminated, as before; this is possible, and does not exhaust the power stored in the capacitor C2, because the power demands of the LCD drive circuit 10 and of the LCD 4 itself are extremely small. Thus, the LCD 4 remains lighted until the off delay action is finished and the timer IC 9 completes its timing, to trigger the transistor Tr to operate the reset coil Xr of the keep relay, as described; but then the LCD 4 is stopped being lit, by the timer IC 9 stopping its oscillation and ceasing to output the LCD drive signal at its terminal f. Thus, because the LCD 4 is kept lighted after the power source becomes switched off, during the timing period until the keep relay is reset, the operator can easily see by ocular inspection that the keep relay has not yet been reset, and can know the operational condition of the device.

Thus, according to the shown structure, the liquid crystal display 4 is driven by the drive circuit 10 therefor while the power source is on, so as to generate an "ON" signal, and then, when said power source is switched off, during said determinate time delay period before this timer generates its off delay output by resetting the keep relay, said liquid crystal display 4 continues to be driven by the drive circuit 10, so that the "ON" indication continues to be displayed during this time delay period. Then, when this timer generates its said off delay output, said liquid crystal display 4 ceases to be driven by the drive unit, so that the "ON" indication ceases to be displayed. Accordingly, this power source off delay timer can provide an ocular indication to the operator of its operation state, i.e. as to whether the off delay output has been produced yet or not, and, due to the extremely small electric power consumption of an LCD, and also the extremely small typical power consumption of such a drive unit for such an LCD, also this power source off delay timer can provide such an ocular indication even for quite a long timed period after stopping of power supply, without putting too much of a strain on the power source such as a capacitor for example which may be used for powering such a power source off delay timer and which may be extremely limited in terms of available power. Accordingly, this power source off delay timer does not risk that its ocular indication of operation should unduly deplete its own power supply reserves, even if the time timed thereby is considerably long. Further, because this power source off delay timer does not involve any mechanical moving linkage mechanism between its keep relay and the LCD 4, but only an electrical linkage, accordingly it allows the mounting position of the LCD 4 to be substantially arbitrarily chosen, and also it allows the mounting position of the keep relay (not shown) to be substantially arbitrarily chosen. Further, this type of power source off delay timer can provide a visible signal which is very noticeable, because it can have included in it an LCD flasher circuit which flashes periodically; although this concept is not specifically shown in the preferred embodiment it should be understood as being within the scope of the present invention. And, because the operation of the display means of this power source off delay timer is not mechanical as in the case of the prior arts mentioned above, but is electronic, and does not involve any moving parts, it provides an ocular indication which is very reliable. Also, because of the inherent compactness of the LCD 4, this power source off delay timer can be made as a compact construction.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A power source off delay timer, for generating an off delay output after passage of a determinate time delay period from when an input power source is switched off, comprising:

(a) a main body;

(b) a liquid crystal display mounted to said main body so as to display the operational condition of said timer; and (c) a liquid crystal display drive unit for driving said liquid crystal display during the time that said power source is on and also during said determinate time delay period between the time instant at which said power source is switched off and the time instant at which said timer generates said off delay output.

2. A power source off delay timer according to claim 1, further comprising a variable resistance whose set value determines said determinate time delay period.

3. A power source off delay timer according to claim 1, further comprising a timer circuit which outputs a drive on signal to said liquid crystal display drive unit to cause it to drive said liquid crystal display, during said determinate time delay period between the time instant at which said power source is switched off and the time instant at which said timer generates said off delay output, and which times said determinate time delay period.

4. A power source off delay timer according to claim 3, further comprising a variable resistance whose set value determines the value of said determinate time delay period timed by said timer circuit.

5. A power source off delay timer according to claim 1, further comprising a flasher circuit for flashing said liquid crystal display when it is being driven.

* * * * *